US010794587B2

(12) United States Patent
Gumkowski

(10) Patent No.: US 10,794,587 B2
(45) Date of Patent: Oct. 6, 2020

(54) SOLID FUEL BOILER BURNER

(71) Applicant: BTI GUMKOWSKI SP. Z O.O. SP. K., Suchy Las (PL)

(72) Inventor: Maciej Gumkowski, Poznan (PL)

(73) Assignee: BTI GUMKOWSKI SP. Z O.O. SP. K., Suchy Las (PL)

( * ) Notice: Subject to any disclaimer, the term of this patent is extended or adjusted under 35 U.S.C. 154(b) by 249 days.

(21) Appl. No.: 15/563,314

(22) PCT Filed: Apr. 1, 2016

(86) PCT No.: PCT/PL2016/000036

§ 371 (c)(1),
(2) Date: Sep. 29, 2017

(87) PCT Pub. No.: WO2016/159804

PCT Pub. Date: Oct. 6, 2016

(65) Prior Publication Data

US 2018/0066839 A1 Mar. 8, 2018

(30) Foreign Application Priority Data

Apr. 2, 2015 (PL) ..... 411861
Apr. 2, 2015 (PL) ..... 411862
Apr. 2, 2015 (PL) ..... 411863

(51) Int. Cl.
*F23B 30/04* (2006.01)
*F24H 9/18* (2006.01)
(Continued)

(52) U.S. Cl.
CPC ..... *F23B 30/04* (2013.01); *F24H 9/1845* (2013.01)

(58) Field of Classification Search
CPC ..... F23B 30/04; F23B 1/32; F24H 9/1845; F23K 1/04; F23D 1/00; F23D 1/02;
(Continued)

(56) References Cited

U.S. PATENT DOCUMENTS 3,229,748 A * 1/1966 Spielman ..... F23C 7/008 431/352
3,599,581 A * 8/1971 Schoppe ..... F23G 5/22 110/158

(Continued)

FOREIGN PATENT DOCUMENTS

EP 2762819 A1 * 8/2014 ..... F23B 40/00
PL 394233 A1 * 9/2012

OTHER PUBLICATIONS

"Machine Translation of EP2762819". 2019.*

*Primary Examiner* — Edelmira Bosques
*Assistant Examiner* — Christopher Matthew Odell
(74) *Attorney, Agent, or Firm* — Egbert Law Offices, PLLC

(57) ABSTRACT

A solid fuel boiler burner has a rotary combustion chamber mounted in casing. The casing is connected by hooks to a gearwheel. The gearwheel is mounted rotationally between a pair of cage bearings. The gearwheel and a compensating and pressure plate have openings for a inflow of air from a blower chamber through an adjustable screen. The adjustable screen controls a ratio of primary to secondary air. A worm feeder delivers fuel to the combustion chamber through an outlet thereof. The worm feeder has an axially placed aeration duct therein.

5 Claims, 3 Drawing Sheets

(51) Int. Cl.
*F23B 30/00* (2006.01)
*F23D 1/00* (2006.01)

(58) Field of Classification Search
CPC ..... F23D 2201/20; F23C 7/008; F23C 6/045; F23G 2205/121; F23G 5/16; F23G 5/444; F23G 5/50
USPC ..... 431/351, 352, 195, 201; 110/263–266, 110/110, 226–228, 246, 327; 403/348, 403/353, 375
See application file for complete search history.

(56) References Cited

U.S. PATENT DOCUMENTS 3,840,328 A * 10/1974 Ashton ..... F23D 11/04 431/168
4,408,547 A * 10/1983 Autere ..... F23B 1/08 110/234
5,372,464 A * 12/1994 Bureller ..... B23B 49/02 403/349
5,680,822 A * 10/1997 Hallberg ..... F23B 3/00 110/261
5,716,205 A * 2/1998 Tratz ..... C10B 47/30 432/103
6,164,220 A * 12/2000 Magnusson ..... F23G 7/105 110/224
6,336,449 B1 * 1/2002 Drisdelle ..... F23B 1/36 126/73
6,889,619 B2 * 5/2005 Okazaki ..... F23C 6/045 110/187
8,904,944 B2 * 12/2014 Riemens ..... F23B 40/04 110/110
8,925,331 B2 * 1/2015 Carrere ..... F23R 3/002 60/798
2004/0134397 A1 * 7/2004 Ingvarsson ..... F23B 1/38 110/347
2012/0318180 A1 * 12/2012 Bang ..... F23G 5/16 110/276
2014/0196638 A1 * 7/2014 Pappinen ..... F23B 30/04 110/341

* cited by examiner

SOLID FUEL BOILER BURNER

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The subject of the invention is a solid fuel boiler burner, used in central heating boilers for building structures and in other heat exchangers.

2. Description of Related Art Including Information Disclosed Under 37 CFR 1.97 and 37 CFR 1.98

In known solutions a rotary fuel transporter, located between the chute unit and the combustion chamber is monolithic. The air supplied by the chute duct is dampened by the mass of the fuel in the transport duct.

In other known solutions a grate of the bottom chute is formed by a ring-shaped or rectangular frame plate, placed above the combustion chamber outlet opening. The solid fuel is pushed and moves onto the grate and combusts. Combustion products in the form of ash are pushed off the grate area by the fresh fuel and fall into the ash pan chamber.

A burner presented in the Polish patent application PL 394233 is known, characterised in that a rotary chamber with a diameter lower than the blower chamber has a fuel feeder inlet, advantageously above the rotary chamber, and an open outlet in the ash pan chamber zone; moreover in its cylinder surface it has openings, covered from the inside of the drum with shielding elements, attached to the internal surface of the drum from the side the fuel moves in, creating above the openings a chamber with a gap placed on the side of the shielding element opposite to the fuel movement direction. This burner requires periodical inspection, and in special cases during a failure, replacement of the unit. This burner has a permanently attached closing plate, to which elements of the fittings are mounted. Access to the elements of the fittings is possible after the closing plate is dismantled.

Air flow drag, related also to the size of fuel pellets, significantly decreases the amount of fuel delivered to the combustion zone, and requires the use of higher powered supply fans, which may reduce the efficiency of the combustion process.

The presented solution eliminates the aforementioned inconveniences.

BRIEF SUMMARY OF THE INVENTION

The essence of the invention, which is a solid fuel boiler burner, with a combustion chamber (1) with aeration openings, the worm feeder (9), and the fuel feeder duct (8) comprises rotary combustion chamber (1). Primary and secondary aeration ducts (26) and (27) are formed between combustion chamber (1) and casing (2). The rotary combustion chamber (1) is mounted in casing (2). The casing (2) is connected by hooks (29) with a gearwheel (6) which is mounted rotationally between two cage bearings (18) placed between the main plate (5) and the compensating and pressure plate (7) having openings (14) and (15) for the inflow of air from the blower chamber (24) through an adjustable screen (11) which controls the ratio of primary to secondary air injected into the primary and secondary aeration ducts (26) and (27) by increasing or decreasing openings (14) and (15), moreover the worm fuel feeder (9) has an axially placed aeration duct (16), with an inlet composed of openings (33) placed in the blower chamber (24) and an outlet composed of openings (35) in the combustion chamber (1).

It is advantageous when the aeration duct (16) has in its outlet zone an injector ending with openings (35).

It is also advantageous when the combustion chamber is connected with the casing by catch (30) and rib (28). The casing (2) is connected to the gearwheel (6) by hook catches (29) positioned in openings along a perimeter of the gearwheel (6) in a frontal plane thereof.

Moreover it is advantageous when the fuel feeding duct (8) from the fuel outlet side have openings (36) that are covered by a screen (39).

Additionally it is advantageous when the aeration ducts (26) and (27) are formed by ribs (4) and (28), which are placed between the internal surface of the casing (2) and the external surface of the combustion chamber (1).

The use of the solution presented in the invention enables the following technical and utility effects:

- the ability to adjust the air fed from the common blower chamber to the primary and secondary air,
- the ability to eject the flow of an air stream by the aeration duct in the worm fuel feeder,
- an increase of combustion effectiveness,
- that combustion products meet all the flue gas cleanliness standards,
- improving the combustion process and obtaining better results of flue gas quality in burners with various constructions of combustion chambers,
- that is maintenance-free during normal operation of the burner,
- the ability to adjust the ratio of primary air to secondary air,
- easy and rapid access to the burner internals and to burner equipment for maintenance and inspection purposes,
- significant shortening of burner downtime required for maintenance and overhaul works,
- rapid and easy disconnecting and connecting of the combustion chamber with the burner body, and
- low construction costs.

BRIEF DESCRIPTION OF THE SEVERAL VIEWS OF THE DRAWINGS

The subject of the invention, in an example, but not limiting, implementation is presented in the figures.

DETAILED DESCRIPTION OF THE INVENTION

Figure 1:
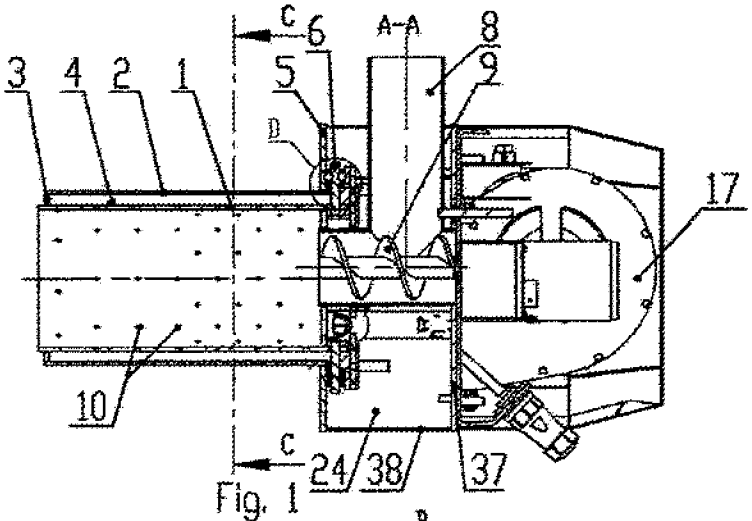
FIG. 1 shows the whole cross-section along the burner.
Figure 2:
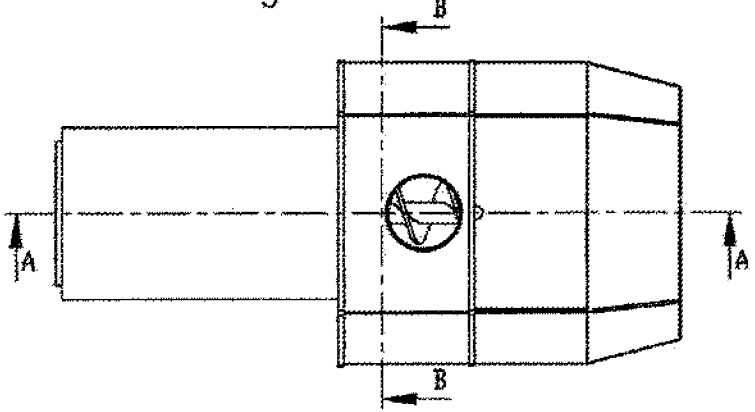
FIG. 2 shows the burner in a top view.
Figure 3:
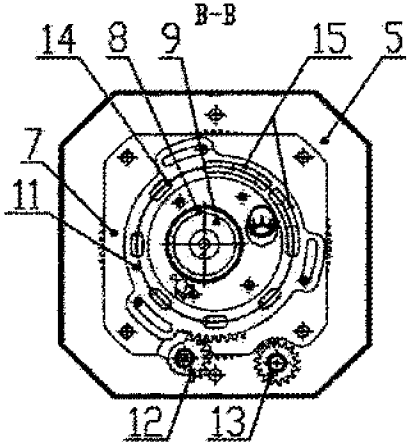
FIG. 3 is a view of the combustion chamber drive unit and the combustion chamber in the B-B cross-section from FIG. 2.
Figure 5:
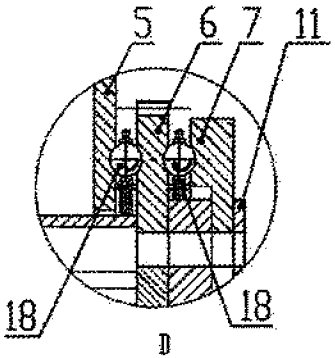
FIG. 5 shows the "D" detail from FIG. 1 demonstrating the bearings.
Figure 4:
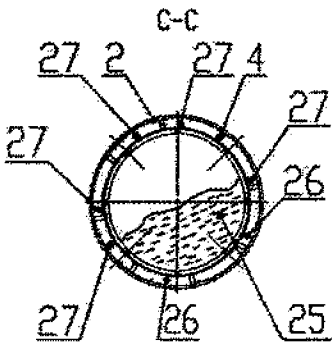
FIG. 4 shows the C-C cross-section from FIG. 1.

The burner has a rotary combustion chamber 1 which is placed on a casing pipe 2 with a ring 3 closing the front of the burner and with ribs 4, and as a unit is connected to a gearwheel 6, which is powered by a gearwheel 13 of the transmission gear with electric motor not shown on the figures. The rotary movement of the combustion chamber 1 is thus ensured.

Moreover the chamber from the drive side is closed by a permanent wall—compensating and pressure plate 7, in which an opening is located, to which pellet fuel feeder duct 8 and an ignition heater hot air injection duct are connected.

The fuel in pellet form is fed into the combustion chamber 1 through the fuel feeder duct 8 using a worm feeder 9 driven by an electric motor drive (not shown in the figures).

The burner is equipped with a blower chamber 24 closed by a main plate 5, bulkhead plate 37 and casing plate 38, into which is forced from the fan 17.

A fuel feeder duct (8) and an ignition heater, as well as a unit for dividing the air into primary air and secondary air are located, in the blower chamber 24.

The combustion chamber 1 is fed with fuel through the fuel feeder duct 8, which may be equipped with secondary air aeration openings, whereas the secondary air is fed by the aeration duct 16 inside the worm feeder 9, which may be equipped with an ending with an injector tip with openings 35 to ensure aftercombustion of some flue gases.

Openings 36 in the fuel feeder duct 8 wall, covered by screen 39 are used to create a stream which prevents gases from flowing towards the fuel inlet. Aeration openings 10 deliver air to the combustion chamber 1, and the openings 32 which supply air to chamber 1 may be covered by the screen 23 in order to adjust the air stream volume.

The chamber's support by the gearwheel 6 is provided with two ball bearings 18 placed on one side on the burner permanent main plate 5, and on the other side on a permanent compensating and pressure plate 7 with spring-adjustable pressure.

The rotary combustion chamber 1 which is placed on a casing 2 with a ring 3 closing the front of the burner and with ribs 4 forms a unit connected to a gearwheel 6, which is powered by a gearwheel 13 of the transmission gear with an electric motor not shown on the figure, and thus the rotary movement of the combustion chamber is ensured. The gearwheel 6 is connected to the combustion chamber 1 and casing 2 unit with hook catches 29.

Air from the ducts 26 and 27 is fed through openings 10 in the combustion chamber 1. Separation of the air volume into individual ducts is performed by a system of openings in the gearwheel 6 and the compensating and pressure plate 7 and appropriate openings 14 and 15 covered by the screen 11 using rotation of the gearwheel 12.

Fuel feeder duct 8 may be equipped with secondary air aeration openings 32, 33 and 36. The secondary air is fed by an aerating duct 16 inside the worm feeder 9, which may be equipped with an ending with injector openings 35 to ensure aftercombustion of some flue gases. The openings 36 in the fuel feeder duct 8 wall are used to create a stream which prevents gases from flowing towards the fuel inlet. The aeration openings 32 and 36 may be covered by the screen 23 and 39 in order to adjust the air stream volume.

The burner is equipped with a blower chamber 24 dosed by the main plate 5, bulkhead plate 37 and casing plate 38, into which air is forced from the fan 17.

In the blower chamber 24 a fuel feeder duct 8 and an ignition heater, as well as a unit for dividing the air into primary air and secondary air are located.

Primary air is understood to be air fed under the combusted bed and passes through the bed, whereas secondary air is the air fed over the bed into the flame zone, used for aftercombustion of the volatile parts.

The primary air ducts 26 and the secondary air ducts 27 are used to supply air to the bed 25. The ducts change their function due to rotation, acting as primary air duets when under the bed and as secondary air ducts when moving above the bed as a result of rotation.

The combustion chamber 1 rotates during operation along with its casing 2, and this unit is placed on the gearwheel 6 placed on two cage bearings 18 placed axially in relation to the combustion chamber axis 1.

Figure 6:
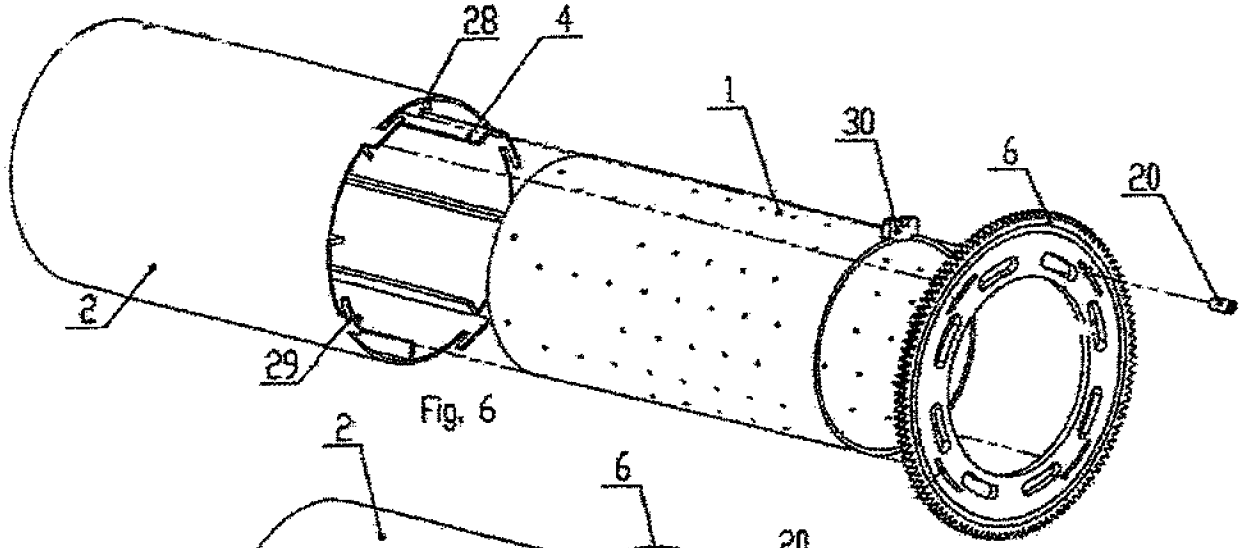
FIG. 6 shows the combustion chamber with disassembled casing.
Figure 7:
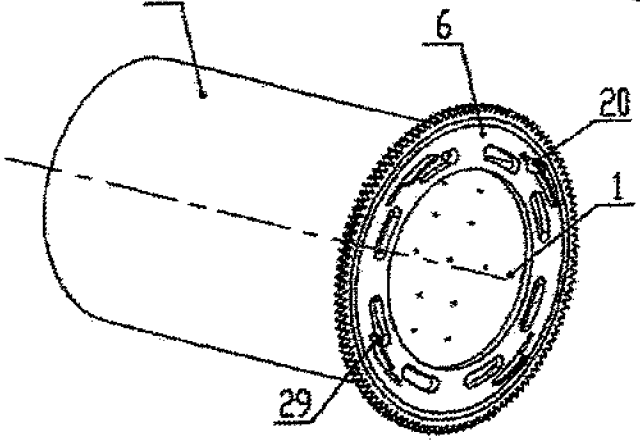
FIG. 7 shows the combustion chamber connected to the gearwheel.
Figure 8:
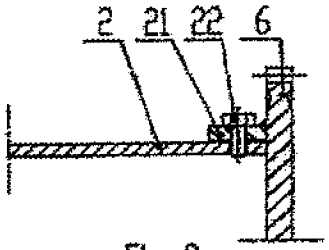
FIG. 8 shows one of the versions of connection of the gearwheel to the combustion chamber.

The combustion chamber 1 with its casing 2 has a structure which enables its rapid assembly and disassembly using catch hooks 29 and is locked with a locking element 20 according to FIG. 6 and may also have a version according to FIG. 8 where it is locked by screw connection (22) of sleeve (21) mounted on the combustion chamber (1) casing (2) with an axially attached gearwheel (6) to the casing (2) of combustion chamber (1).

The combustion chamber 1 also has a protective element 30, as shown in FIG. 6, which protects the combustion chamber against sliding out and which enables the transmission of its rotation together with the casing 2 using the rib 28.

The fuel feeder duct 8 in the fuel discharging section to the combustion chamber 1 is equipped with aeration openings 36 which ensure swirling on the circumference of the fuel feeder duct's 8 cylinder generator line. The slotted openings are equipped with versions according to FIG. 9 in the form oblique, parallel or perpendicular to the cylinder generator line.

Figure 9:
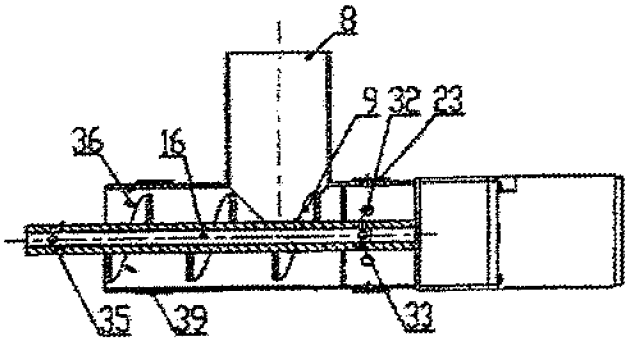
FIG. 9 is a cross-section of the fuel supply duct with the fuel transport and aeration mechanism.

The aeration openings 36 and 32 according to FIG. 9 are covered by screens, respectively 39 and 23 by sliding them along the fuel feed duct 8 axis or by their rotation on the cylinder part of this duct.

The fuel worm feeder 9 has on its axis an aerating duct 16 with an afterburner ending with holes 35. The worm elements may be constructed of metal or ceramics.

The fuel feeder worm 9 has on its axis an aerating duct 16 with an afterburner ending with a bell ending version (open).

Adjustment of the amount of secondary air to primary air is performed through throttling the flow of air with openings 14 and 15 fed into the secondary air ducts by decreasing or increasing the inner diameter of the openings using the diaphragm 11 moved by the gearwheel 12.

Figure 10:
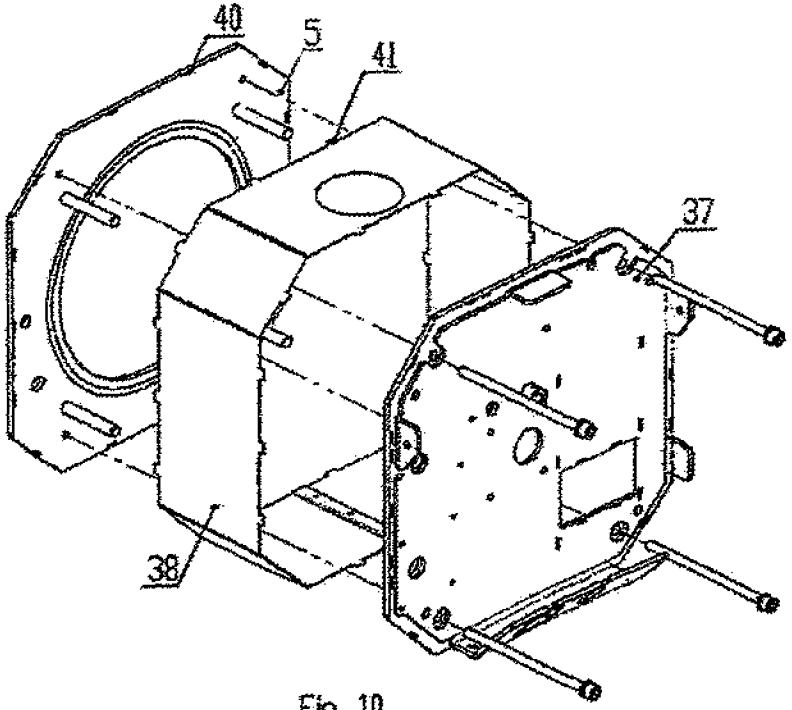
FIG. 10 shows the disassembled casing of the drive unit.

The main plate 5 and the bulkhead plate 37 of the blower chamber 24 are equipped with slotted openings 40 according to FIG. 10 on the line connecting them to casing plate 38, which is equipped with splines 41, which enter the plates and fix the position of these elements.

Rotary combustion chamber 1 is also made of heat-resistant steel or of ceramics.

The combustion chamber 1 rotates during operation along with its casing 2, and this unit is mounted on gearwheel 6.

The invention claimed is:

1. A solid fuel boiler burner apparatus comprising:

a combustion chamber having aeration openings, the aeration openings adapted to supply air to a burning fuel;

a rotary worm feeder cooperative with said combustion chamber, said rotary worm feeder having an initial zone, said rotary worm feeder adapted to supply fuel to said combustion chamber, the initial zone of said rotary worm feeder located in a fuel feeder duct;

a casing having said combustion chamber mounted therein, said casing having primary air ducts and secondary air ducts, said casing being connected by hook catches to a gearwheel, the gearwheel being rotationally mounted between a pair of cage bearings positioned between a main plate and a compensating and pressure plate, said casing having openings for an inflow of air from a blower chamber through an adjustable screen, the adjustable screen controlling a ratio of primary air and secondary air respectively injected into the primary air ducts and the secondary air ducts by increasing or decreasing an area of the openings, said rotary worm feeder having an axially positioned aeration duct, the aeration duct having an inlet with openings positioned in the blower chamber and an outlet having openings in said combustion chamber.

2. The solid fuel boiler burner of claim 1, wherein the aeration duct has an injector in the outlet thereof.

3. The solid fuel boiler burner of claim 1, wherein the combustion chamber is connected with said casing by a catch and a rib, wherein said casing is connected to the gearwheel by said hook catches positioned in openings along a perimeter of the gearwheel in a frontal plane thereof.

4. The solid fuel boiler burner of claim 1, wherein an outlet of said fuel feeder duct has a wall with openings that are covered by a screen.

5. The solid fuel boiler burner of claim 1, wherein the primary air ducts and the secondary air ducts are defined by ribs formed between an internal surface of said casing and an external surface of said combustion chamber.

* * * * *